US009909439B2

(12) United States Patent
Bluck et al.

(10) Patent No.: US 9,909,439 B2
(45) Date of Patent: Mar. 6, 2018

(54) GAS TURBINE ROTOR BLADE AND GAS TURBINE ROTOR

(71) Applicant: Siemens Aktiengesellschaft, Munich (DE)

(72) Inventors: Richard Bluck, Lincoln (GB); David Butler, Nottingham (GB); Jonathan Mugglestone, Nottingham (GB); David Overton, Lincoln (GB)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 277 days.

(21) Appl. No.: 14/763,727

(22) PCT Filed: Jan. 14, 2014

(86) PCT No.: PCT/EP2014/050620
§ 371 (c)(1),
(2) Date: Jul. 27, 2015

(87) PCT Pub. No.: WO2014/117998
PCT Pub. Date: Aug. 7, 2014

(65) Prior Publication Data

US 2015/0361814 A1 Dec. 17, 2015

(30) Foreign Application Priority Data

Feb. 1, 2013 (EP) ..... 13153706

(51) Int. Cl.
*F01D 11/00* (2006.01)
*F01D 5/02* (2006.01)
*F01D 5/14* (2006.01)

(52) U.S. Cl.
CPC ..... *F01D 11/008* (2013.01); *F01D 5/02* (2013.01); *F01D 5/147* (2013.01); *F01D 11/006* (2013.01);
(Continued)

(58) Field of Classification Search
CPC .... F01D 11/005; F01D 11/006; F01D 11/008; F01D 5/02; F05D 2240/55; F05D 2240/57; F05D 2240/80; F05D 2240/81
See application file for complete search history.

(56) References Cited

U.S. PATENT DOCUMENTS 2,912,223 A * 11/1959 Hull, Jr. ..... F01D 5/22 416/221
6,079,944 A 6/2000 Tomita et al.
(Continued)

FOREIGN PATENT DOCUMENTS

CA 2251192 C 1/2002
CN 101529054 A 9/2009
(Continued)

OTHER PUBLICATIONS

RU Decision of Grant dated Jan. 23, 2017, for RU patent application No. 2015132092.
(Continued)

*Primary Examiner* — Mark Laurenzi
*Assistant Examiner* — Xiaoting Hu
(74) *Attorney, Agent, or Firm* — Beusse Wolter Sanks & Maire

(57) ABSTRACT

A gas turbine rotor and blade include a root portion, a platform and airfoil portion arranged along a span direction of the rotor blade, the platform located between the root and airfoil portion. The platform has an upstream and downstream side, side faces which extend from upstream to downstream side, an axial groove in each side face extends
(Continued)

perpendicular to the span direction with a minor component of extension in span direction. A radial groove in each side face extends towards the axial groove with a component of extension in span direction and a component of extension perpendicular to the span direction. The radial groove has a first end that shows away from the axial groove and a second end that shows towards the axial groove. The second end is located a distance from the axial groove forming a groove free section between the second end and axial groove.

17 Claims, 2 Drawing Sheets

(52) U.S. Cl.
CPC ..... *F05D 2220/32* (2013.01); *F05D 2240/55* (2013.01); *F05D 2240/57* (2013.01); *F05D 2240/80* (2013.01); *F05D 2240/81* (2013.01); *F05D 2250/294* (2013.01); *Y10T 29/49323* (2015.01)

(56) References Cited

U.S. PATENT DOCUMENTS

| | | | | |
|---|---|---|---|---|
| 6,086,329 | A * | 7/2000 | Tomita | F01D 11/006 277/634 |
| 6,273,683 | B1 * | 8/2001 | Zagar | F01D 5/22 277/421 |
| 6,309,175 | B1 * | 10/2001 | Hahnle | F01D 5/187 415/115 |
| 6,561,764 | B1 * | 5/2003 | Tiemann | F01D 11/006 416/193 A |
| 7,575,415 | B2 * | 8/2009 | Drerup | F01D 11/005 29/888.3 |
| 8,613,599 | B2 | 12/2013 | Lake et al. | |
| 2006/0056975 | A1 * | 3/2006 | Honkomp | F01D 5/3007 416/193 A |
| 2008/0181779 | A1 * | 7/2008 | Decardenas | F01D 5/147 416/219 R |
| 2009/0169369 | A1 | 7/2009 | Morgan et al. | |
| 2010/0129226 | A1 * | 5/2010 | Strohl | F01D 5/3007 416/219 R |
| 2010/0178173 | A1 * | 7/2010 | Charlton | F01D 11/006 416/248 |
| 2010/1178173 | | 7/2010 | Charlton | |
| 2010/0284800 | A1 | 11/2010 | Sewall et al. | |
| 2011/0014050 | A1 | 1/2011 | Lake et al. | |
| 2011/0229344 | A1 * | 9/2011 | Johnson | F01D 5/181 416/97 R |
| 2012/0049467 | A1 * | 3/2012 | Stewart | F01D 5/22 277/641 |
| 2012/0121424 | A1 | 5/2012 | Wassynger et al. | |
| 2012/0171040 | A1 * | 7/2012 | Walunj | F01D 5/22 416/220 R |
| 2012/0237350 | A1 | 9/2012 | Corcoran et al. | |
| 2012/0244002 | A1 | 9/2012 | Meka | |
| 2013/0171001 | A1 * | 7/2013 | Garcia-Crespo | F01D 5/3007 416/241 B |

FOREIGN PATENT DOCUMENTS

| | | | |
|---|---|---|---|
| CN | 101836018 | A | 9/2010 |
| CN | 102705018 | A | 10/2010 |
| DE | 1034638 | A1 | 4/2005 |
| DE | 10346384 | A1 | 4/2005 |
| DE | 102004016174 | A1 | 10/2005 |
| EP | 0911490 | A2 | 4/1999 |
| EP | 2201271 | B1 | 3/2012 |
| JP | 2003526039 | A | 9/2003 |
| JP | 2011196379 | A | 10/2011 |
| JP | 2012107621 | A | 6/2012 |
| RU | 2415272 | C2 | 3/2011 |

OTHER PUBLICATIONS

CA Examiner's Report dated Feb. 6, 2017, for CA patent application No. 2898337.
Office Action dated Oct. 13, 2016, for RU patent application No. 2015132092.
CN Office Action dated Sep. 9, 2016, for CN application No. 201480007025.2.

* cited by examiner

GAS TURBINE ROTOR BLADE AND GAS TURBINE ROTOR

CROSS REFERENCE TO RELATED APPLICATIONS

This application is the US National Stage of International Application No. PCT/EP2014/050620 filed Jan. 14, 2014, and claims the benefit thereof. The International Application claims the benefit of European Application No. EP13153706 filed Feb. 1, 2013. All of the applications are incorporated by reference herein in their entirety.

FIELD OF INVENTION

The present invention relates to a gas turbine rotor blade as well as to a gas turbine rotor comprising a number of gas turbine rotor blades and seal strips between neighboring rotor blades.

BACKGROUND OF INVENTION

Gas turbines generally include a rotor with a number of rows of rotating rotor blades which are fixed to a rotor shaft and rows of stationary vanes between the rows of rotor blades which are fixed to the casing of the gas turbine. When a hot and pressurized working fluid flows through the rows of vanes and blades it transfers momentum to the rotor blades and, thus, imparts a rotary motion to the rotor while expanding and cooling. The vanes are used to control the flow of the working medium so as to optimize momentum transfer to the rotor blades.

A typical gas turbine rotor blade comprises a root portion by which it is fixed to the rotor shaft, an aerodynamically formed airfoil portion the design of which allows a transfer of momentum when the hot and pressurized working fluid flows along the airfoil section. It further comprises a platform that is located between the root portion and the airfoil portion. The surface of the platform which shows towards the airfoil portion forms a wall section of the flow path for the hot and pressurized working medium.

Since the working medium is hot the turbine blades of a row of blades are installed such to the rotor shaft that gaps remain between neighboring platforms so that an expansion of the gas turbine rotor blade due to the heat of the working medium is not hindered. Moreover, in order to actively cool the turbine blade a cooling fluid, typically pressurized air from the compressor, is led along the root side of the platform and sometimes also through the interior of the airfoil section. In older designs open cooling loops have been used in which the pressurized cooling air is released into the flow path of the working medium after passing the turbine blade. However, high efficiency gas turbine engines require closed cooling loops, in which the cooling air is not released to the flow path of the working medium but returned to the compressor after recooling it. Such closed loop cooling systems rely on sealing the gap between neighboring rotor blades.

Rotor blades with sealing strips or sealing pins between neighboring rotor blades are disclosed in DE10346384A1, US2009/169369A1, US2010/0284800A1, U.S. Pat. No. 6,273,683 B1, US U.S. Pat. No. 6,561,764 B1, US 2010/0129226 A1, and EP 2 201 271 B1. Typically, such sealing strips or sealing pins are held in place by grooves located in side faces of the platforms. Since also the sealing strips expand when exposed to the hot working medium the dimensions of the grooves are typically a bit larger than the length and the thickness of the seal strips or seal pins.

SUMMARY OF INVENTION

With respect to the described prior art it is an objective of the present invention to provide a gas turbine rotor blade that allows for a good sealing of the gap between the platforms of neighboring rotor blades. It is a further objective of the invention to provide an advantageous gas turbine rotor.

The first objective is achieved by a gas turbine rotor blade as claimed, the second objective by a rotor as claimed. The depending claims contain further developments of the invention.

An inventive gas turbine rotor blade includes along a span direction of the rotor blade a root portion, a platform and an airfoil portion arranged with the platform being located between the root portion and the airfoil portion. The platform comprises an upstream side, a downstream side, and side faces which extend from the upstream side to the downstream side. An axial groove is present in each side face of the platform which axial groove extends substantially perpendicular to the span direction with a minor component of extension in span direction. The ratio of the minor component of extension to the groove extension in axial direction typically lies between 0.03 and 0.1. Moreover, a radial groove is present in each side face of the platform which radial groove extends towards the axial groove with a component of extension in span direction and a component of extension perpendicular to the span direction. The ratio of the component perpendicular to the span direction to the component of extension in span direction may be in the range of 0.3 and 0.5. The radial groove has a first end that shows away from the axial groove and a second end that shows towards the axial groove. The second end is located at a distance from the axial groove so that a groove free section is formed between the second end of the radial groove and the axial groove.

In the inventive rotor blade the axial groove is not strictly axial but slightly inclined. The reason therefore is, that the surface of the platform forming the wall of the flow path for the working medium is also typically not perpendicular to the span direction of the rotor blade. By giving the groove a slight inclination the groove can be made parallel to the surface of such a platform. Hence, the distance of the cooled area of the platform from the surface forming the wall of the flow path is the same along the whole platform. Providing an inclination in the axial groove, however, can lead to a sliding movement of a seal strip inserted into the groove due to centrifugal forces of the rotating rotor which the rotor blade is part of. In particular, with rotors of small diameter such a movement of the seal strip occurs. If the radial groove would be open towards the axial groove a sliding of the seal strip positioned in the axial groove due to the centrifugal force could lead to a situation where the radial seal can move radially outwards due to the centrifugal force which would lead to a leak path around the radial seal.

By having a groove free section between the second end of the radial groove and the axial groove such a movement of the radial seal can be prevented. Although a small leak path is formed in the area of the groove free section the leakage through this groove free section is well defined since the dimension of the leak path is fixed, and the total leakage can be reduced as compared to a situation where the groove free section is not present so that the radial seal could move radially outwards when the rotor is rotating. Hence, by introducing a well defined leak path the total leakage can be reduced. Further, the well defined leak path ensures a known and repeatable total leakage through each seal and through the whole rotor blade assembly.

In an implementation of the inventive gas turbine rotor blade, the minor component of extension of the axial groove in span direction is such that the axial groove is inclined towards the airfoil portion, as seen from the downstream side towards the upstream side of the platform.

In a further development of the inventive gas turbine rotor blade, a further groove is present in the side face of the platform. This further groove is open towards the axial groove and towards the upstream side of the platform. Moreover, the further groove is inclined away from the airfoil portion, as seen from the downstream side towards the upstream side of the platform. If the seal strip is made from a flexible material this further groove can be used for inserting the seal strip from the upstream side of the rotor blade. If the axial groove is inclined towards the airfoil portion, as seen from the downstream side of the platform towards the upstream side, it can be achieved that the seal strip is moved into its sealing position after insertion through the further groove by the centrifugal force acting on the seal strip when the rotor is rotating. In addition, a further seal strip may be placed into the further groove after the seal strip has been inserted into the axial groove.

In a still further development of the inventive gas turbine rotor blade, the component of extension of the radial groove perpendicular to the span direction is such that the radial groove is inclined towards the upstream end of the platform, as seen from the first end of the radial groove towards its second end.

If the radial groove is open at its first end a seal strip can be inserted into the groove from the downstream side of the platform.

Additionally, the open ends of the grooves are important such that the blades are mounted to the disc first before installation of the seal strips. This can allow smaller gaps between opposing side faces as well as removal and/or replacement of the seal strips without disassembling the whole rotor assembly.

It is another advantage that the grooves and/or seal strips overlap in the axial direction such that the groove-free section has a dimension in the radial direction between the grooves and/or seal strips. The groove-free section has a dimension or extension in the radial direction between the grooves and/or seal strips such that there is a clear line-of-sight in the axial direction and into a cavity defined by the blade's platform.

The further groove is open at its distal end to allow insertion of a strip seal.

The axial groove and the radial groove are arranged to overlap in the axial direction. The overlap in the axial direction is at least the length defined from an upstream end of the axial groove to a junction of the further groove and the axial groove.

The groove-free section has a dimension in the radial direction between the axial groove and the radial groove. In other words at least a portion of the radial groove is in radial alignment with at least a portion of the axial groove. In particular, the radial groove is located radially inwardly of the axial groove where applied to a radially inner platform or opposing face of a turbine blade. In particular, the radial groove is located radially outwardly of the axial groove where applied to a radially outer platform or opposing face of a turbine blade.

The dimension in the radial direction is arranged to provide a clear line-of-sight in the axial direction and into a cavity defined by the rotor blades.

In the inventive gas turbine rotor blade, the extension in span direction of the groove free section between the second end of the radial groove and the axial groove is advantageously in the range of 50% to 150% of the width of the axial groove, in particular in the range between 75% and 100% of the width of the axial groove. By having a groove-free section with dimensions in the mentioned range the leak path generated by this section can be kept small enough so that the leakage is less than without such a groove-free section and a radial seal strip moving radially outwards by centrifugal force.

According to a further aspect of the invention, a gas turbine rotor is provided. The inventive gas turbine rotor extends along an axial direction and comprises a number of inventive gas turbine rotor blades. The rotor blades are arranged side by side in a circumferential direction of the rotor in such a manner that gaps remain between neighboring rotor blades. Axial seals extend between neighboring rotor blades which seals are held in place by the axial grooves in the side faces of the platforms of the neighboring rotor blades. In addition, radial seals extend between neighboring rotor blades and are held in place by the radial grooves in the side faces of the platforms of the neighboring rotor blades.

By using inventive gas turbine rotor blades in the inventive rotor a leakage through the gaps between the rotor blades can be reduced by providing a defined leakage as described above with reference to the inventive gas turbine rotor blade.

Although a defined leakage is introduced with the use of the inventive gas turbine rotor blade the groove free section of the inventive rotor blade ensures that the axial seal and the radial seal act independently. If this did not happen the leakage would even be greater. Thus, by introducing the defined leakage the leakage of the rotor can be reduced, as compared to the use of rotor blades with inclined axial grooves and no groove-free section between the radial groove and the axial groove.

The axial seal can be implemented as seal strip or seal pin. Likewise, the radial seal can be implemented as a seal strip or a seal pin. In particular, it would also be possible to realize one of the seals as a seal strip while the other is realized as a seal pin.

According to another aspect of the present invention there is provided a method of assembling a rotor assembly comprising the steps of firstly, mounting at least two rotor blades in accordance with the present invention to a rotor disc, secondly, either inserting an axial seal strip through an open end of the further groove such that is it wholly or substantially within the axial groove or inserting a radial seal strip into the radial groove via the open end and followed by the alternative. Optionally, the method includes arranging a lock plate across the open end to prevent release of the seal strip. It is an advantage that in the inventive rotor blade either or both the seal strips may be inserted or assembled to their grooves after each of the blades has been assembled to the rotor assembly. Thus equal or designed amounts of leakage can be allowed through or between circumferentially adjacent blades.

BRIEF DESCRIPTION OF THE DRAWINGS

Further features, properties and advantages of the present invention will become clear from the following description of specific embodiments in conjunction with the accompanying drawings.

DETAILED DESCRIPTION OF INVENTION

An embodiment of an inventive gas turbine rotor blade will now be described with respect to FIGS. 1 and 2 in which the rotor blade 25 is mounted to a rotor disc 27 about a rotational axis 100. The terms axial, radial and circumferential are with respect to the rotational axis. The rotational axis 100 is normally the rotational axis of an associated gas turbine engine.

Figure 1:
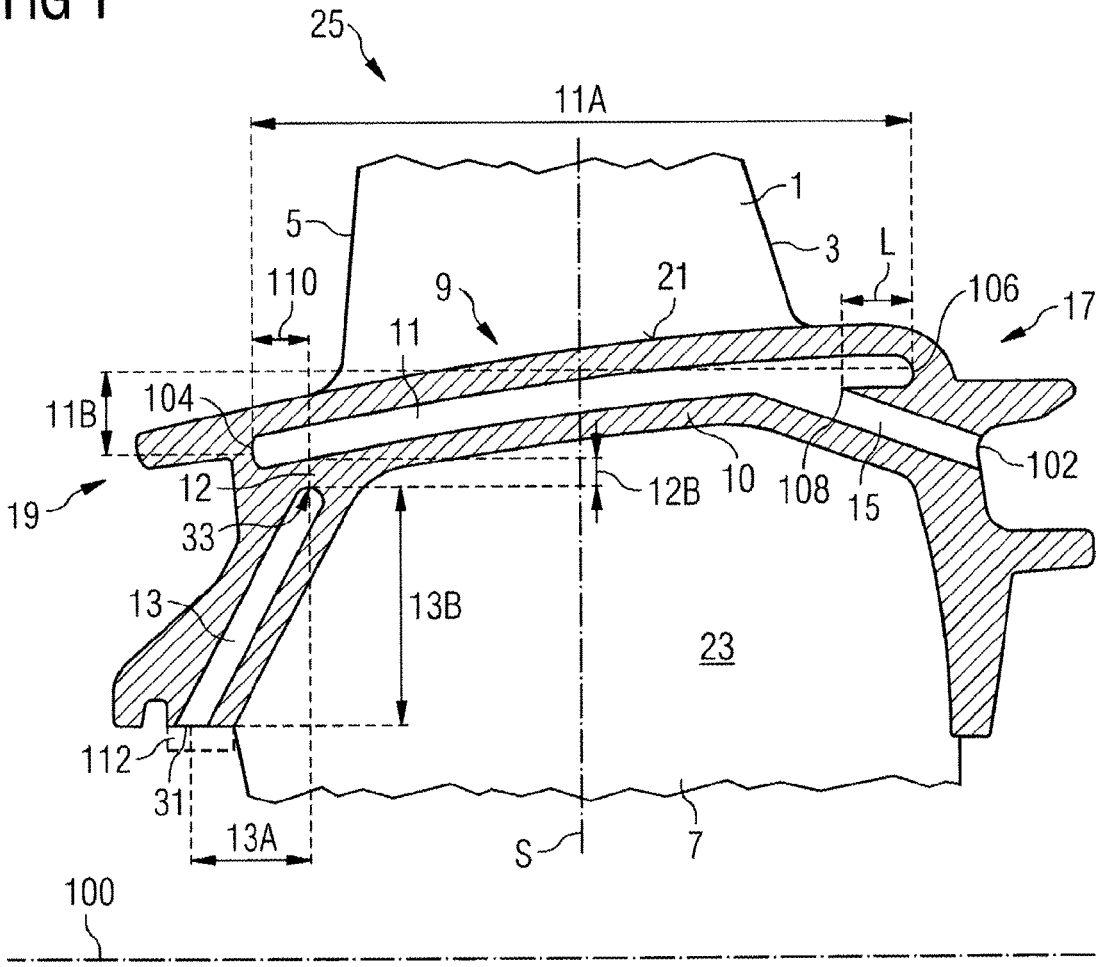
FIG. 1 shows an inventive gas turbine rotor blade.

FIG. 1 shows the rotor blade in a side view in such an orientation that the span direction is the vertical or radial direction in the Figure. The Figure shows an airfoil portion 1, a root portion 7 and a platform 9 of the rotor blade. The platform is located between the airfoil portion 1 and the root portion 7. The span direction mentioned above corresponds to a direction that is perpendicular to the cord, which is a notional straight line connecting the leading edge 3 of the airfoil portion 1 to the trailing edge 5.

The platform 9 of the rotor blade according to the present embodiment is equipped with three kinds of grooves, namely first grooves 11, which are called axial grooves in the following, a second groove 13, which is called radial groove in the following, and further grooves 15. These grooves 11, 13, 15 are located in side faces 10 of the platform 9 which connect an upstream side 17 of the platform 9 to a downstream side 19. The surface 21 of the platform forms a wall of a flow path for a hot and pressurized working medium which is led along the airfoil section 1 to impart momentum to a rotor the rotor blade is part of together with a rotor shaft to which the rotor blade is fixed. The rotor blade is fixed to the rotor shaft by means of its root portion 7, as will be described later with respect to FIG. 2.

On the root side of the platform 9 a cavity 13 is formed which is supplied with compressor air for cooling the platform when the rotor blade is in operation. The cooling air may also be led through the interior of the airfoil portion to cool this portion, too.

Figure 2:
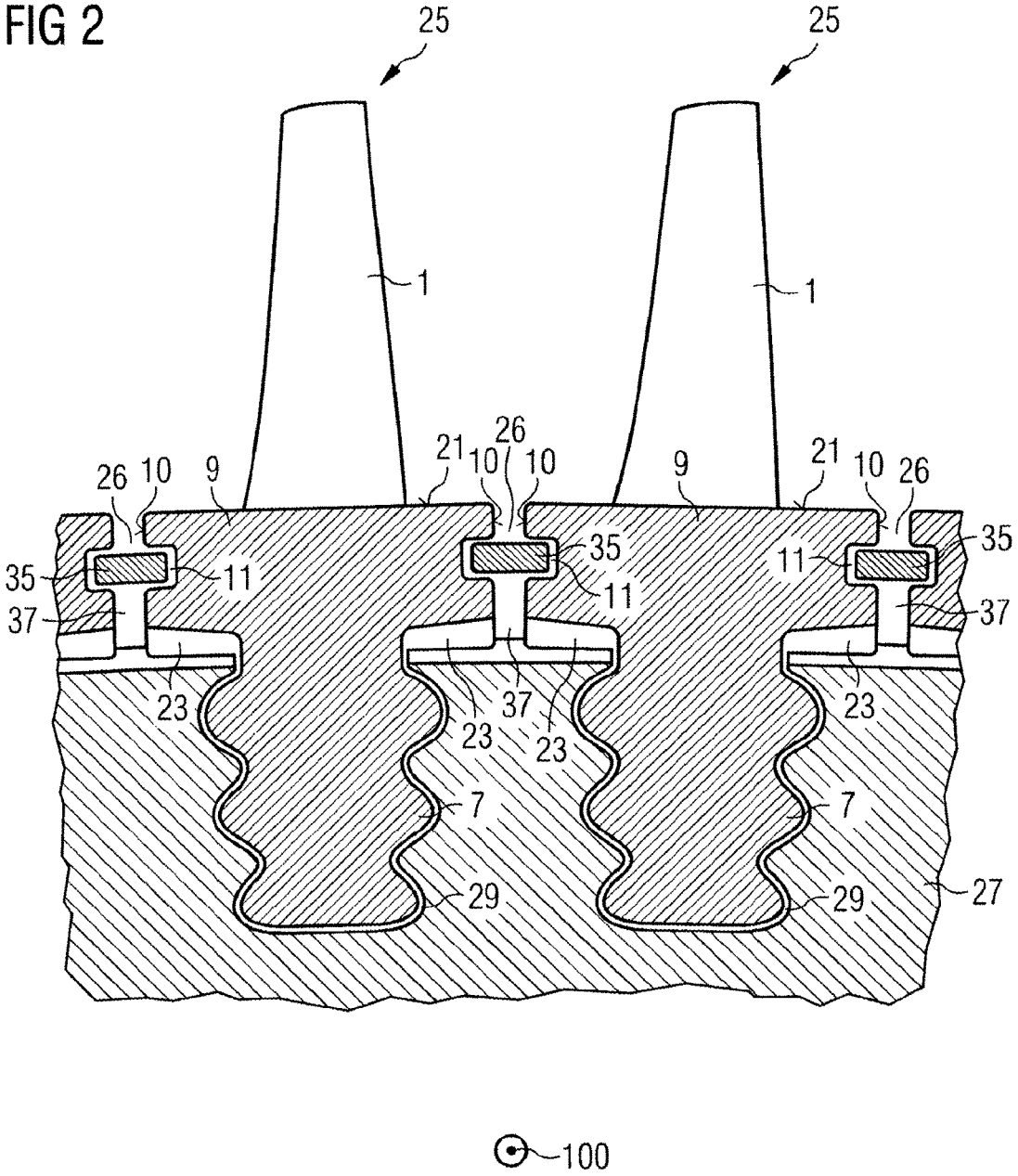
FIG. 2 schematically shows a section of an inventive rotor.

FIG. 2 shows a section of a rotor that is equipped with inventive rotor blades. The Figure shows the rotor in a sectional view where the section is in the circumferential direction of the rotor. In other words, FIG. 2 shows a view in axial direction of the rotor, which corresponds to a view onto the rotor blades along a direction extending from the upstream sides 17 to the downstream side 19. Please note that the upstream sides 17 of the rotor blades are cut away in the sectional view of FIG. 2.

The rotor blades 25 are fixed to the rotor shaft 27 by means of their root portions 7. These root portions have a shape that corresponds to notches 29 in the rotor shaft. Please note that the rotor shaft 27 may be composed of a number of rotor discs stacked along the axial direction of the rotor where each row of rotor blades is carried by an individual disk. The notches 29 of a row of rotor blades are then part of a single disc while the notches of a further row of rotor blades are part of another disc.

In the view shown in FIG. 2 one can see the airfoil portion 1, the root portion 7 and the platform 9 of the rotor blades. The rotor blades 25 are fixed such to the rotor shaft 27 that gaps 26 remain between the side faces 10 of neighboring rotor blades 25. Also visible are the axial grooves 11 in the side faces 10 of the platforms 9 and the cavities 23 below the platforms 9. Not visible in FIG. 2 are the radial grooves 13 and the further grooves 15. From FIG. 2 the reference to axial groove and radial groove becomes clear. The axial grooves 11 run more or less parallel to the axial direction of the rotor with a minor component of extension in radial direction of the rotor while the extension of radial grooves has a large component in radial direction. The radial direction more or less corresponds to the span direction shown in FIG. 1.

The extension of the axial groove 11 and the extension of the radial groove 13 will be further explained with reference to FIG. 1, where the components of extension are indicated. The axial groove 11 has a direction of extension with a major component 11A in axial direction of the rotor, which direction is more or less perpendicular to the span direction S, and a minor component of extension 11B in span direction. The ratio of the minor component 11B to the major component is in the range of 0.03 to 0.1. In other words, the size of the minor component 11B is between 3% and 10% of the major component. By providing the extension of the axial groove with a minor radial component an inclination of the axial groove is introduced. The inclination is such that this axial groove 11 is inclined towards the airfoil section as seen from the downstream side 19 to the upstream side 17 of the platform 9.

The ratio of the axial component of extension 13A of the radial groove 13 to the radial component of extension 13B of the radial groove 13 is in the range of 0.3 to 0.5. In other words, the axial component corresponds to 30% to 50% of the radial component. By this measure, an inclination in the direction of extension of the radial groove 13 is introduced such that the radial groove 13 is inclined towards the upstream side 17 of the platform, as seen from a first, lower end of the groove 13 to a second, upper end 33.

As can be seen from FIG. 1, in the present embodiment the radial groove 13 extends from a first end 31, which is an open end, towards the axial groove 11. However, it does not reach the second groove 11 so that the second end 33 is a closed end and a groove-free section 12 is formed between the second end 33 of the radial groove 13 and the axial groove 11. The extension or dimension 12B of the groove-free section 12 in span or radial direction is in the range of 50% to 150% of the width of the axial groove. In particular, the extension 12B may be in the range of 75% to 100% of the width of the axial grove 11. The meaning of this groove-free section 12 will be explained later.

The further groove 15 is open towards the axial groove 11 and the upstream side 15 and is also inclined but in a different orientation than the axial groove 11 and the radial groove 13. In other words, the inclination of the further groove 15 is such that it is inclined away from the airfoil portion (or towards the root portion), as seen from the downstream side 19 of the platform 9 towards the upstream 17 side. The meaning of the further groove will also be explained later.

The axial grooves 11 and the radial grooves 13 in the side faces 10 of the platforms 9 hold axial seals 35 and radial seals 37, respectively, when the rotor blades 25 are installed to a rotor shaft 27. These seals 35, 37 bridge the gap 26 between the platforms 9 of neighboring rotor blades to seal the cavity 23 for preventing the cooling air led through the cavity 23 from entering the flow path of the working medium. However, a well-defined leakage of cooling air into the flow path is allowed by the groove-free section 12 between the second end 33 of the radial grove 13 and the axial groove 11 since this groove-free section 12 is also a seal-free section. However, this groove-free section prevents the radial seal 37 from moving upwards in FIG. 1 when the rotor is rotating. If the radial groove 13 was open towards the axial groove 11, such an upward movement would be possible because the length of the axial seal 35 is smaller than the length of the axial groove 11. Hence, the centrifugal force would drive the axial seal towards the upstream side 17 of the platform 9 due to the centrifugal force acting on the seal. This movement would provide the space for an upward movement of the radial seal 13. Such an upward movement would create leak path around the radial seal which would be larger than the defined leak path through the groove-free, and hence seal-free, section 12 between the second end 33 of the radial groove 13 and the axial groove 11.

The length of the axial seal 35 is smaller than the length of the axial groove 11 to allow installing a resilient seal strip through the further groove 15 into the axial groove 11. When installing the resilient seal strip the strip is moved through the further groove 15 into the axial groove 11 until the downstream end of the axial groove 11 is reached. Then, the upstream end of the resilient seal strip can snap upwards so that the seal strip is fully located in the axial groove 11. When the rotor then is rotating by a certain amount of revolutions per minute the axial seal strip moves towards the upstream end of the axial groove 11 driven by centrifugal force which would allow the radial seal strip to move upwards if the groove-free section 12 was not present. Hence, by forming a groove-free section 12 between the second end 33 of the radial groove 13 and the axial groove 11 it can be ensured that, whilst creating leak path, the two seals act independently which in the end leads to a smaller leakage area as compared to a situation where the groove free section 12 was not present.

The further groove 15 has an open end 102 through which the seal strip is first inserted. The axial groove has a downstream end 104 and an upstream end 106. The length of the axial seal 35 is smaller than the length of the axial groove 11 by at least a length L defined from the upstream end 106 to the junction 108 of the further groove 15 and the axial groove 11.

The axial groove 11 and the radial groove 13 are arranged to overlap 110 in the axial direction. The overlap may be very small such that at least a portion of each groove is radially aligned. In the exemplary embodiment shown, the overlap 110 in the axial direction is at least the length L. The overlap may be twice the length L.

In the present embodiment, installation of the radial seal 37 is done through the open lower end 31 of the radial groove 13. The seal strip is secured against slipping out of the radial groove 13 by means of a locking plate 112, which is not shown in the Figures. Likewise, a seal strip in the further groove 15 may be secured by a locking plate.

The rotor blade 25 is part of a rotor assembly including the rotor disc 27. A method of assembling the rotor assembly comprises mounting at least two rotor blades to the rotor disc. Inserting the axial seal strip 35 through the open end 102 of the further groove 15 to reach (or near to) the downstream end 104 of the axial groove 11. The seal strip 35 is resilient and spring radially outwardly such that is it wholly or substantially within the axial groove 11. Inserting the radial seal strip 37 into the radial groove via the open end 31 and arranging the lock plate across the open end 31 to prevent release of the seal strip 37. It should be noted that where there are two circumferentially adjacent blades 25 the terms groove and openings may be defined by corresponding grooves and openings on the opposing side faces 10. Thus the open ends 31, 102 are important such that the blades are mounted to the disc first before installation of the seal strips. This can allow smaller gaps between opposing side faces 10 as well as removal and/or replacement of the seal strips without disassembling the whole rotor assembly.

The present invention has been illustrated by describing specific embodiments of the invention. However, the invention is not meant to be restricted to these specific embodiments. For example, while seal strips have been described in the embodiments seal pins could be used as well. In addition, the shape of the root sections shown in FIG. 2 could be different to what is shown in the Figure. Hence, the scope of protection shall only be delimited by the appended claims.

The invention claimed is:

1. A gas turbine rotor blade including a root portion, a platform and an airfoil portion arranged along a span direction of the rotor blade with the platform being located between the root portion and the airfoil portion, the platform comprising:

an upstream side, a downstream side, side faces which extend from the upstream side to the downstream side, an axial groove in each side face of the platform, said axial groove extends substantially perpendicular to the span direction with a minor component of extension in the span direction, and a radial groove in each side face of the platform, said radial groove extends towards the axial groove with a component of extension in the span direction and a component of extension perpendicular to the span direction, and wherein the radial groove has a first end that shows away from the axial groove and a second end that shows towards the axial groove, and wherein the second end is located at a distance from the axial groove so that a groove-free section is formed between the second end of the radial groove and the axial groove, and wherein a further groove is present in each side face of the platform, wherein said further groove is open towards the axial groove and towards the upstream side of the platform and wherein said further groove is inclined away from the airfoil portion, as seen from the downstream side towards the upstream side, and wherein the axial groove has an upstream end and a downstream end and wherein a junction of the further groove and the axial groove is separated by a length from the upstream end of the axial groove.

2. The gas turbine rotor blade as claimed in claim 1, wherein the minor component of extension of the axial groove in the span direction is such that the axial groove is inclined towards the airfoil portion, as seen from the downstream side towards the upstream side.

3. The gas turbine rotor blade as claimed in claim 1, wherein the component of extension of the radial groove perpendicular to the span direction is such that the radial groove is inclined towards the upstream side of the platform, as seen from the first end of the radial groove towards the second end of the radial groove.

4. The gas turbine rotor blade as claimed in claim 1, wherein the first end of the radial groove is open.

5. The gas turbine rotor blade as claimed in claim 1, wherein an extension of the groove-free section in the span direction between the second end of the radial groove and the axial groove is between 50% to 150% of a width of the axial groove.

6. The gas turbine rotor blade as claimed in claim 1, wherein the minor component of extension of the axial groove in the span direction corresponds to between 3% to 10% of the an axial extension of the axial groove.

7. The gas turbine rotor blade as claimed in claim 1, wherein the component of extension of the radial groove perpendicular to the span direction corresponds to between 30% to 50% of the component of extension of the radial groove in the span direction.

8. The gas turbine rotor blade as claimed in claim 1, wherein the further groove is open at a distal end.

9. The gas turbine rotor blade as claimed in claim 1, wherein the axial groove and the radial groove are arranged to overlap in an axial direction.

10. The gas turbine rotor blade as claimed in claim 1, wherein the groove-free section has a dimension in the span direction between the axial groove and the radial groove.

11. The gas turbine rotor blade as claimed in claim 10, wherein the dimension in the span direction provides a clear line-of-sight in an axial direction and into a cavity defined by the platform and wherein the cavity is supplied with compressed air.

12. A gas turbine rotor extending along an axial direction, comprising:

a number of gas turbine rotor blades according to claim 1 wherein the rotor blades are arranged side by side in a circumferential direction of the rotor in such a manner that gaps remain between the platforms of neighboring rotor blades, axial seals which extend between neighboring rotor blades and which are held in place by the axial grooves in the side faces of the platforms of the neighboring rotor blades, and radial seals which extend between neighboring rotor blades and which are held in place by the radial grooves in the side faces of the platforms of the neighboring rotor blades.

13. A method of assembling a rotor assembly, comprising:

firstly, mounting at least two rotor blades as claimed in claim 1 to a rotor disc, secondly, inserting an axial seal strip through an open end of the further groove such that it is wholly or substantially within the axial groove, and inserting a radial seal strip into the radial groove via the first end, wherein the first end is open.

14. The method as claimed in claim 13, further comprising arranging a lock plate across the first end to prevent release of the radial seal strip.

15. The method as claimed in claim 13, wherein a length of the axial seal strip is smaller than a length of the axial groove such that the inserting the axial seal strip comprises moving the axial seal strip through the further groove until the axial seal strip reaches the downstream end of the axial groove.

16. The method as claimed in claim 15, wherein the inserting the axial seal strip further comprises moving an upstream end of the axial seal strip upwards so that the axial seal strip is fully located in the axial groove.

17. A gas turbine rotor blade including a root portion, a platform and an airfoil portion arranged along a span direction of the rotor blade with the platform being located between the root portion and the airfoil portion, the platform comprising:

an upstream side, a downstream side, side faces which extend from the upstream side to the downstream side, an axial groove in each side face of the platform, said axial groove extends substantially perpendicular to the span direction with a minor component of extension in the span direction, and a radial groove in each side face of the platform, said radial groove extends towards the axial groove with a component of extension in the span direction and a component of extension perpendicular to the span direction, and wherein the radial groove has a first end that shows away from the axial groove and a second end that shows towards the axial groove, and wherein the second end is located at a distance from the axial groove so that a groove-free section is formed between the second end of the radial groove and the axial groove, wherein a further groove is present in each side face of the platform, wherein said further groove is open towards the axial groove and towards the upstream side of the platform and wherein said further groove is inclined away from the airfoil portion, as seen from the downstream side towards the upstream side, wherein the axial groove and the radial groove are arranged to overlap in an axial direction, and wherein the overlap in the axial direction is at least a length defined from an upstream end of the axial groove to a junction of the further groove and the axial groove.

* * * * *